US011353028B2

(12) United States Patent
Dinkins et al.

(10) Patent No.: US 11,353,028 B2
(45) Date of Patent: Jun. 7, 2022

(54) ELECTRIC SUBMERSIBLE PUMP WITH DISCHARGE RECYCLE

(71) Applicant: Halliburton Energy Services, Inc., Houston, TX (US)

(72) Inventors: Walter Dinkins, Tulsa, OK (US); David Houston, Mounds, OK (US); Donn J. Brown, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 415 days.

(21) Appl. No.: 16/476,509

(22) PCT Filed: Oct. 3, 2018

(86) PCT No.: PCT/US2018/054245
§ 371 (c)(1),
(2) Date: Jul. 8, 2019

(87) PCT Pub. No.: WO2020/072053
PCT Pub. Date: Apr. 9, 2020

(65) Prior Publication Data

US 2021/0348612 A1 Nov. 11, 2021

(51) Int. Cl.

| | |
|---|---|
| ***F04D 13/10*** | (2006.01) |
| ***F04D 9/00*** | (2006.01) |
| ***F04D 29/70*** | (2006.01) |
| ***E21B 43/12*** | (2006.01) |

(52) U.S. Cl.
CPC ..... *F04D 13/10* (2013.01); *E21B 43/128* (2013.01); *F04D 9/001* (2013.01); *F04D 9/005* (2013.01); *F04D 29/708* (2013.01)

(58) Field of Classification Search
CPC ..... F04D 13/10; F04D 9/001; F04D 9/005; F04D 29/708; E21B 43/128
See application file for complete search history.

(56) References Cited

U.S. PATENT DOCUMENTS 3,276,384 A * 10/1966 Boone ..... F04D 9/005 415/11
6,173,774 B1 1/2001 Fox
6,357,530 B1 3/2002 Kennedy et al.
6,457,531 B1 10/2002 Bangash et al.
(Continued)

FOREIGN PATENT DOCUMENTS

CN 204386564 U 6/2015
DE 543770 * 1/1927

OTHER PUBLICATIONS

International Search Report and Written Opinion dated Jul. 2, 2019, International PCT Application No. PCT/US2018/054245.

*Primary Examiner* — Charles G Freay
(74) *Attorney, Agent, or Firm* — McGuireWoods LLP

(57) ABSTRACT

Included are electric submersible pump assemblies, methods of use, and systems incorporating said electric submersible pump assemblies. An example electric submersible pump assembly comprises an electric submersible pump comprising a pump intake, a storage chamber in fluid communication with the discharge side of the electric submersible pump, and a tubing configured to allow for fluid communication between the pump intake and the storage chamber such that fluid may flow from the storage chamber into the pump intake.

20 Claims, 4 Drawing Sheets

(56) References Cited

U.S. PATENT DOCUMENTS

| | | | | |
|---|---|---|---|---|
| 6,684,946 | B2 * | 2/2004 | Gay | E21B 34/08 166/105 |
| 9,932,806 | B2 * | 4/2018 | Stewart | E21B 47/008 |
| 2005/0230121 | A1 | 10/2005 | Martinez et al. | |
| 2012/0263606 | A1 | 10/2012 | Bouldin et al. | |
| 2020/0088201 | A1 * | 3/2020 | Bourne | F04D 29/40 |

* cited by examiner

ELECTRIC SUBMERSIBLE PUMP WITH DISCHARGE RECYCLE

TECHNICAL FIELD

The present disclosure relates to electric submersible pumps, and more particularly, to an electric submersible pump with a discharge recycle for mitigating or preventing the gas lock of the electric submersible pump.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubblepoint, a high water cut, and/or a low API gravity. Moreover, ESPs may also be used in in any production operation to increase the flow rate of the production fluid to a target flow rate.

Generally, an ESP comprises an electric motor, a seal section, a pump intake, and a pump (e.g., a centrifugal pump). These components may all be connected with a series of shafts. For example, the pump shaft may be coupled to the motor shaft through the intake and seal shafts. The electric motor supplies torque to the shafts, which provides power to the pump. Fluids, for example, reservoir fluids may enter the wellbore where they may flow past the outside of the motor to the pump intake. These fluids may then be produced by being pumped to the surface inside the production tubing via the pump, which discharges the reservoir fluids into the production tubing.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potential prevent the intake of the reservoir fluid. This phenomenon is referred to as a "gas lock" because the ESP may not be able to operate properly due the accumulation of gas within the ESP. Provided are improved ESPs for mitigating or preventing the gas lock of the ESP.

BRIEF DESCRIPTION OF THE DRAWINGS

Illustrative examples of the present disclosure are described in detail below with reference to the attached drawing figures, which are incorporated by reference herein, and wherein.

Figure 1:
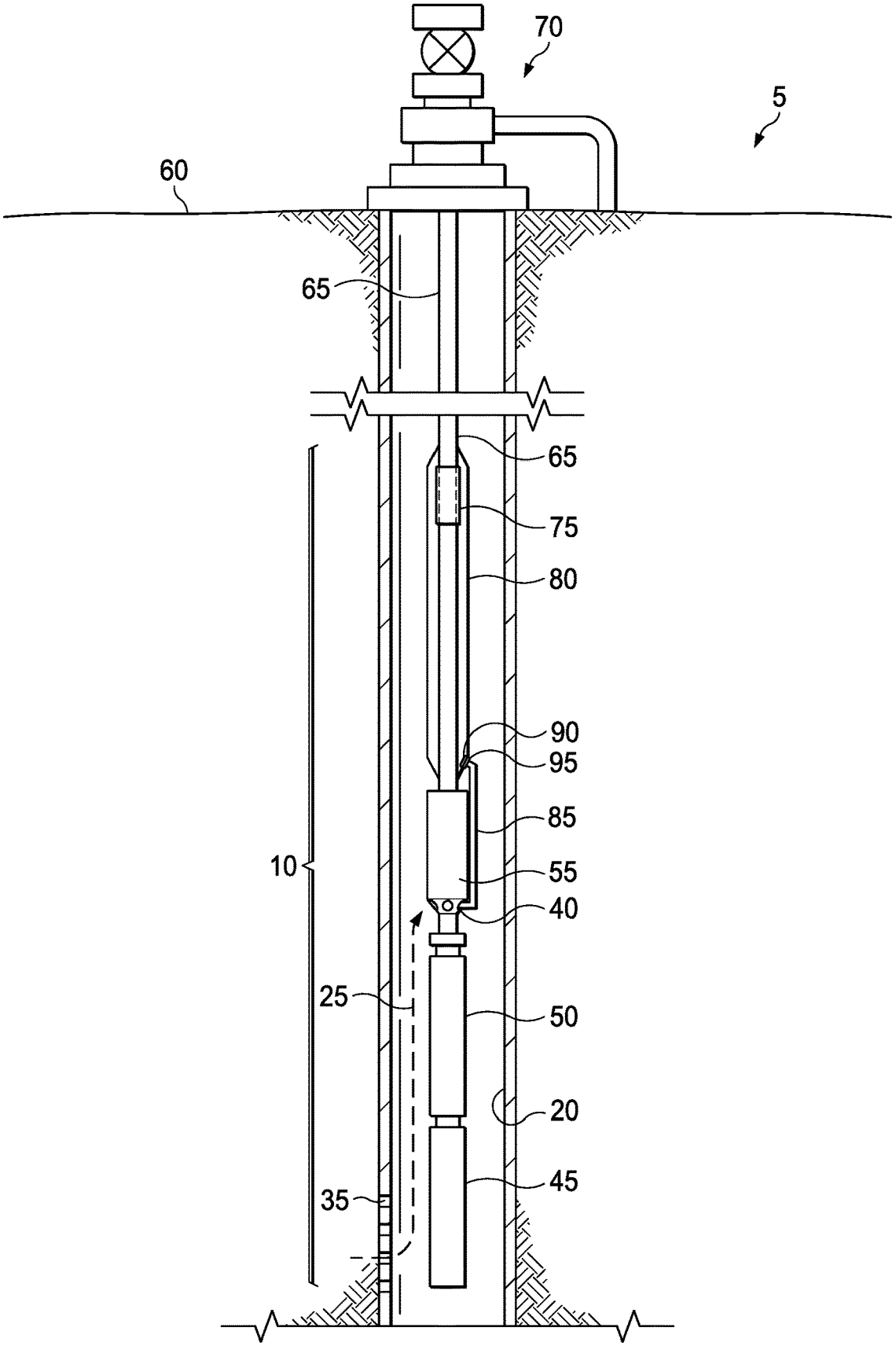
FIG. 1 is a schematic illustrating a production system including an ESP assembly in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates to electric submersible pumps, and more particularly, to an electric submersible pump with a discharge recycle for mitigating or preventing the gas lock of the electric submersible pump.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms "uphole" and "downhole" may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the ESPs described herein comprise a discharge recycle. One of the many potential advantages of the disclosed ESP is that the ESP may be back-filled with discharged fluid in the event of the discharge pressure of the ESP being reduced below a target threshold, which may be indicative of gas entering the ESP. This may result in prolonging the life of the ESP in wells in which gas slugs can occur, as the discharge recycle may prevent the gas from filling the pump internal volume. As such, the ESP may mitigate the damage the gas slug may do as well as prevent the gas lock of the ESP. Another potential advantage of the ESP is that it selectively recycles the ESP discharge. A storage chamber is filled with filtered discharge from the ESP and is only flowed back to the ESP intake when the discharge pressure is reduced below the predetermined pressure threshold. As such, the ESP may maintain a ready volume of liquid discharge, without interference with the normal operation of the ESP.

FIG. 1 is a schematic illustrating a production system, generally 5, including an ESP assembly, generally 10. The ESP assembly 10 may be vertical or angled downhole in the wellbore 15 of a well. The well may be an oil well, water well, etc., and may contain any type of reservoir fluid 25. In some examples, the wellbore 15 may be cased with a casing 20, for example, a cement sheath. In other examples, the wellbore 15 may not be cased. Reservoir fluid 25 may enter the wellbore 15 from a subterranean formation 30 via the casing perforations 35. In some examples, there may also be reservoir fluid 25 already present in the wellbore 15. The reservoir fluid 25 may enter the ESP assembly 10 via the pump intake 40. The ESP assembly 10 generally comprises an electric motor 45, a seal section 50, a pump 55, and the pump intake 40.

The pump 55 may be any pump sufficient for lifting a reservoir fluid 25 to the surface. Without limitation, an example of pump 55 is a centrifugal pump. Downhole of pump 55 is the seal section 50. The seal section 50 seals the electric motor 45 from the remainder of the ESP assembly 10. The electric motor 45 powers the ESP assembly 10 by supplying torque to the shafts connecting the aforementioned components of the ESP assembly 10. For example, the motor shaft, seal shaft, intake shaft, and pump shaft may be coupled together (e.g., splined) and all may be rotated by the electric motor 45. In the interest of clarity, these shafts are not visible in FIG. 1 as they are internal to the ESP assembly 10. The electric motor 45 may be powered by electricity transmitted from the surface 60 via any sufficient electrical connection.

Production tubing 65 may convey the reservoir fluid 25 to the wellhead 70. The production tubing 65 may be coupled to the ESP assembly 10 via any sufficient coupling, for example, threaded, bolted, welded, etc.

As the reservoir fluid 25 flows into the pump intake 40, the reservoir fluid 25 is produced by being lifted uphole to the wellhead 70. As this reservoir fluid 25 flows uphole through the production tubing 65, the reservoir fluid 25 may contact a filter 75 disposed on a section of the production tubing 65. The filter 75 is disposed over a portion of the production tubing 65 that is fluidically communicable with a storage chamber 80 disposed around the production tubing 65 and creating an annulus around production tubing 65 that is discrete from the wellbore annulus. Filter 75 may be any such exclusionary means useful for allowing throughflow of the reservoir fluid 25, while excluding solids such as sand, wellbore solids, debris, etc. which may be dispersed or suspended in the reservoir fluid 25. In some examples, the filter 75 only allows for one-way flow into the storage chamber 80 and there may be positioned in the throughports or openings of filter 75, a check valve or other such means sufficient for preventing two-way flow and specifically flow from the storage chamber 80 back into the production tubing 65. The filter 75 may be positioned such that normal flow of the reservoir fluid 25 uphole and through the production tubing 65 flushes the solids off the filter 75 as the production fluid flows uphole to the wellhead 70 during normal operation. For example, the pores or exclusionary means of the filter 75 may be kept in the flowpath of production tubing 65 and may not be recessed or otherwise positioned such that the uphole fluid flow through production tubing 65 is not sufficient to flush any solids off the face of the filter 75. An example of filter 75 is a brass filter with porous openings of sufficiently small size to exclude solid particles while allowing fluid flow therethrough. Filter 75 may keep storage chamber 80 and tubing 85, both discussed in more detail below, free from solids which may clog tubing 85 and prevent the draining of storage chamber 80 when needed for keeping the pump 55 filled with fluid in the event of gas accumulation within the pump 55. Another function of filter 75 is to allow storage chamber 80 to breathe when the valve 95 is open as is discussed below. Failure to provide a method to equalize pressure in storage chamber 80 may prevent the reservoir fluid 25 stored in the storage chamber 80 from draining via the valve 95.

Storage chamber 80 is disposed external to the production tubing 65 and may be wrapped around all or a portion of the production tubing 65. In some examples, storage chamber 80 is a type of tubular that is concentric with production tubing 65. Production tubing 65 may be disposed within the innermost diameter of the storage chamber 80. As described above, storage chamber 80 is in fluid communication with the production tubing 65 via the filer 75. Fluid flowing through the production tubing 65 may enter the storage chamber 80 via one or more openings regulated by filter 75 or other such exclusionary means. As fluid enters the storage chamber 80, it may fill the storage chamber 80, charging it until needed for flowback to the pump intake 40. Once the storage chamber 80 is filled to capacity, fluid may flow past the filter 75 and continue flowing uphole. This uphole discharge flow maintains the discharge pressure from the pump 55 within the storage chamber 80 allowing for the storage chamber 80 to be in continuous pressure communication with the discharge side of pump 55. In some examples, storage chamber 80 may extend uphole for one or more production tubing 65 joints past the point where pump 55 discharges the fluid in the production tubing 65.

A tubing 85 is coupled to the storage chamber 80 and disposed downhole of the filter 75. The tubing 85 is in fluid communication with the storage chamber 80. An example of tubing 85 is a capillary tube. Fluid flow from storage chamber 80 into tubing 85 is selectively controlled via pressure sensor 90 and valve 95. When the pressure (i.e., the pump 55 discharge pressure) within the storage chamber 80 decreases below a desired threshold as determined by the pressure sensor 90, the valve 95 may open releasing the fluid within the storage chamber 80 into the tubing 85 where it is flowed to the pump intake 40 and then discharged by the pump 55. This recycled reservoir fluid 25 may reenter the storage chamber 80 or be flowed uphole in the production tubing 65 to the wellhead 70. The pump 55 discharge pressure within the storage chamber 80 may decrease below the desired threshold in the event that a sufficient volume of gas has accumulated on the intake side of the pump 55. This gas accumulation may reduce the volume of fluid discharge by the pump 55, which may reduce the pump 55 discharge pressure measured by the sensor 90. The recycled reservoir fluid 25 enters the pump intake 40 and maintains liquid in the pump intake 40, assisting the pump 55 in discharging the gas within the pump 55. The pump 55 discharge may continue to be recycled until the pump 55 discharge pressure measured by sensor 90 increases to a level where it again exceeds the predetermined threshold, inducing the valve 95 to close. The storage chamber 80 may then be recharged by the reservoir fluid 25 discharged from the pump 55 via the filter 75 as described above.

Although sensor 90 and valve 95 are described as separate components, it is to be understood that in some examples, sensor 90 and valve 95 may be a single assembly, for example, any type of check valve or one-way valve in which the cracking pressure can be predetermined and/or set as desired. In some examples, operation of the valve 95 may be automatic upon the pressure differential reaching the threshold. An example of this configuration is a spring-loaded check valve. The spring represents the sensor 90 that measures the pump 55 discharge pressure. When this pressure exceeds the spring force, the valve 95 is automatically opened as the pump 55 discharge pressure has reached the cracking pressure threshold and the plunger, stopper, or other such valve sealing element is pushed away from the sealing surface of the valve 95. In some alternative examples, operation of the valve 95 may not be automatic upon the pressure differential reaching the threshold. The sensor 95 may measure the pump 55 discharge pressure and produce an electric signal via a transducer or other such means. This signal may operate the valve 95 if the valve 95 has been configured to allow such instruction. Alternatively, this signal may be conveyed to an operator via any type of transceiver or other communication means as known in the art. The operator may then send a communication signal to the valve 95 to open the valve 95. This example may be useful in situations in which the operator would prefer to employ an option for shutting down the valve 95 operation remotely until it is desired for use. Regardless, and as discussed above, in all examples the recycling of the pump 55 discharge is selective. The pump 55 discharge is only recycled upon the pump 55 discharge pressure being reduced below the pressure threshold as measured by sensor 90, with such threshold potentially being indicative of gas accumulation in the ESP assembly 10.

Figure 2:
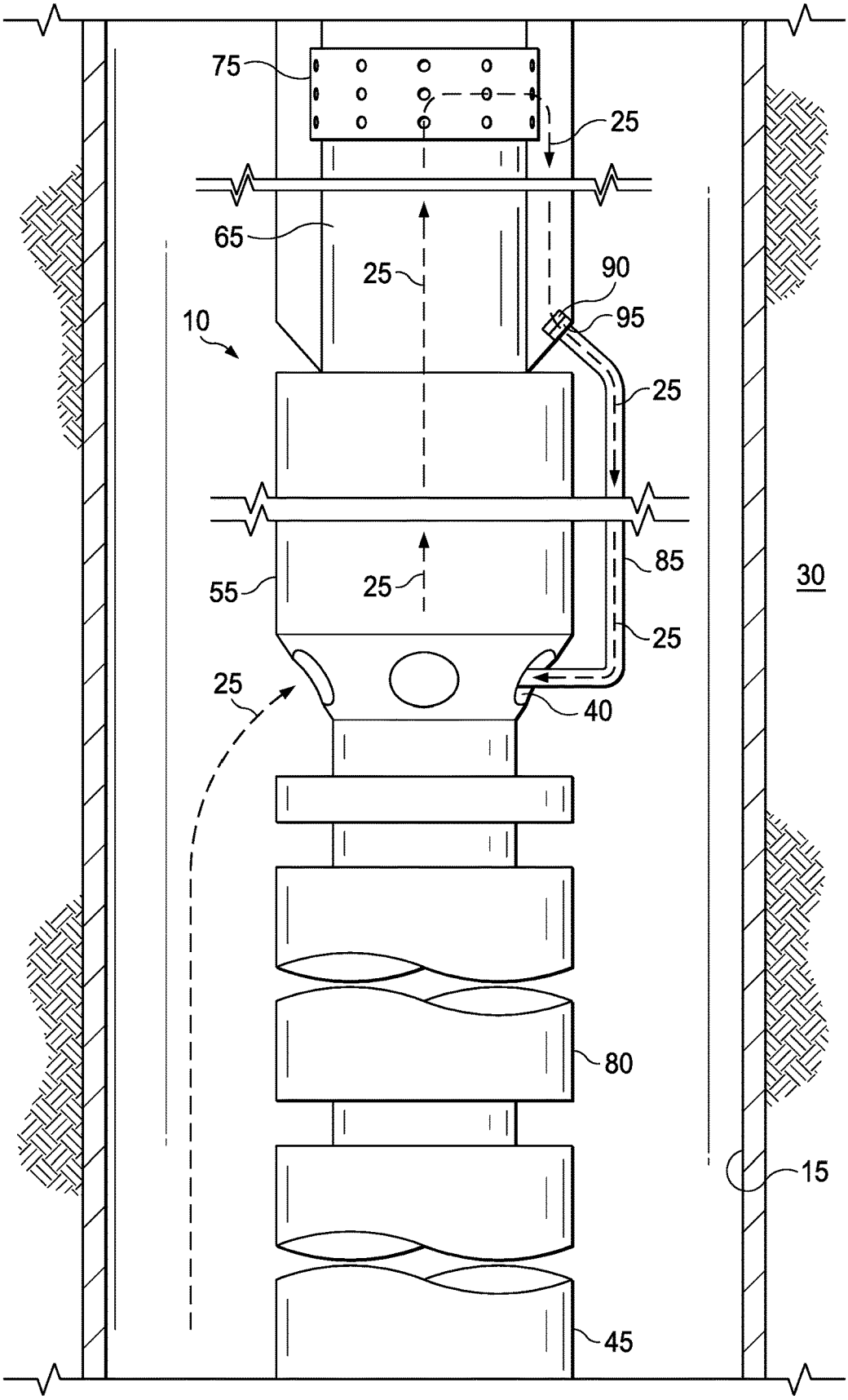
FIG. 2 is schematic illustrating the flow of reservoir fluid into the ESP assembly of FIG. 1 and the recycling of the reservoir fluid discharge in accordance with one or more examples described herein.

FIG. 2 is a schematic illustrating the flowpath of reservoir fluid 25 as it enters the ESP assembly 10. ESP assembly 10 comprises an electric motor 45, a seal section 50, a pump 55, and the pump intake 40 as discussed above. Reservoir fluid 25 may enter the wellbore 15 from the subterranean formation 30. The reservoir fluid 25 may then flow past the motor 45 and the seal section 50. The reservoir fluid may enter the pump 55 via the pump intake 40. The reservoir fluid 25 may then be pumped upwards into the production tubing 65. Along a portion of production tubing 65, a filter 75, or any other type of exclusionary means may be disposed. The filter 75 allows the fluid portion of reservoir fluid 25 to enter storage chamber 80 while excluding at least a portion of any solids that may be suspended or otherwise dispersed in reservoir fluid 25. Upward flow of reservoir fluid 25 in production tubing 65 may keep the filter 75 clean of solids such as sand and wellbore debris that may be deposited on the face of the filter 75 when the reservoir fluid 25 filtrate flowed through.

Reservoir fluid 25 may fill storage chamber 80, which as illustrated, is adjacent to production tubing 65. Storage chamber 80 is designed to store any desired volume of reservoir fluid 25 for a specific application and, in some examples, may span several joints of production tubing 65 uphole of the point of pump 55 discharge. The reservoir fluid 25 may be disposed in the storage chamber 80 until the valve 95 is opened. When the valve 95 is opened, the reservoir fluid 25 may fill the storage chamber 80 to capacity, or close to capacity, and continue flowing uphole via production tubing 65. Should the fluid pressure within the storage chamber 80 drop due to a reduction or cessation in the uphole flow of the reservoir fluid 25, for example, due to gas accumulating on the suction side of the pump 55 and impeding fluid flow therethrough, a sensor 90 that is responsive to this drop in fluid pressure may induce the valve 95 to open. When the valve 95 opens, the stored reservoir fluid 25 within the storage chamber 80 is allowed to flow into the tubing 85 and downhole to the pump intake 40. This recycled reservoir fluid 25 may keep the pump 55 wet thereby preventing the gas lock of the pump 55 and/or the accumulation of gas in the suction side of the pump 55. In some examples, the recycled reservoir fluid 25 may assist in the removal of a portion of the accumulated gas as the recycled reservoir fluid 25 passes through the pump 55 again.

When a sufficient amount of gas has been removed from the pump 55 and the flowthrough of reservoir fluid 25 is resumed, the fluid pressure within the storage chamber 80 may return to its previous measure as the storage chamber 80 begins to recharge. The valve 95 may close and remain closed as storage chamber 80 again reaches capacity and the recycling of the discharged reservoir fluid 25 is halted until and unless it is needed again.

It should be clearly understood that the production system 5 and ESP assembly 10 of FIGS. 1 and 2 are merely one example of an application of the principles of this disclosure in practice, and a wide variety of other examples are possible. Therefore, the scope of this disclosure is not limited at all to the details of FIGS. 1 and 2 described herein and/or depicted in any of the other FIGURES.

Figure 3:
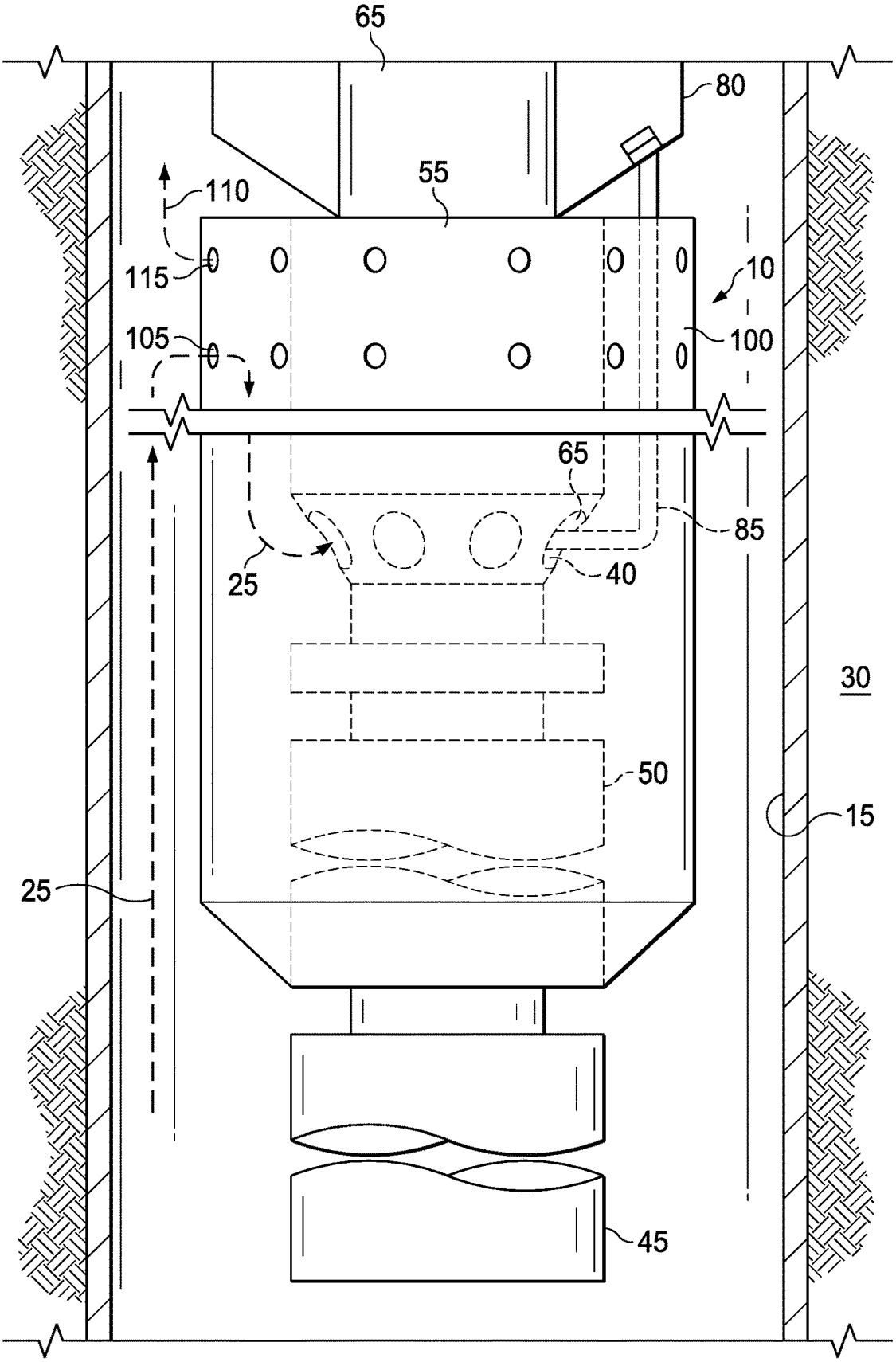
FIG. 3 is schematic illustrating the flow of reservoir fluid into the ESP assembly of FIG. 2 but with the addition of an inverted shroud over a portion of the ESP assembly in accordance with one or more examples described herein.

FIG. 3 is a schematic illustrating an ESP assembly 10 further comprising an inverted shroud 100. The inverted shroud 100 may be positioned over the pump 55 or may be positioned on the production tubing 65 or over the storage chamber 80 at any point that is uphole of the pump 55. An inverted shroud 100 generally comprises a shroud intake 105 located uphole of pump intake 40. Reservoir fluid 25 may enter shroud intake 105. The inverted shroud 100 generally functions to flow the reservoir fluid 25 uphole of the pump intake 40 such that any gas present within the reservoir fluid 25 may continue to rise and flow uphole while the liquid portion of the reservoir fluid 25 flows downhole to the pump intake 40. The separated gas 110 may rise in the inverted shroud 100 until it exits via shroud outtake 115 where it may be returned to the wellbore 15. The shroud outtake 115 may be disposed uphole of the shroud intake 105. As illustrated, the discharge recycle assembly (e.g., the filter 75, storage chamber 80, sensor 90, valve 95, and the tubing 85) portion of the ESP assembly 10 is compatible with the inverted shroud 100. In examples comprising the inverted shroud 100, the inverted shroud may be fit over the pump 55. In some examples, the inverted shroud 100 may be fit over a portion or the whole of the storage chamber 80. In still further examples, the inverted shroud 100 may also be fit over a portion of the production tubing 65. In examples, where the inverted shroud 100 does not cover the storage chamber 80, the tubing 85 may be run from the storage chamber 80 into an opening in the inverted shroud 100 where it may access and allow flow into pump intake 40. The opening in the inverted shroud 100 may be cut or otherwise fabricated into any portion of the inverted shroud 100. Alternatively, the tubing 85 may be inserted into one of the shroud intakes 105 or shroud outtakes 115.

The inverted shroud 100 is one example of an additional gas mitigation apparatus for ESP assembly 10 that is compatible with the discharge recycle assembly of ESP assembly 10. Other types of shrouds or gas mitigation apparatuses may be used as would be readily apparent to one of ordinary skill in the art.

It should be clearly understood that the ESP assembly 10, including the inverted shroud 100 of FIG. 3 is merely one example of an application of the principles of this disclosure in practice, and a wide variety of other examples are possible. Therefore, the scope of this disclosure is not limited at all to the details of FIG. 3 described herein and/or depicted in any of the other FIGURES.

Figure 4:
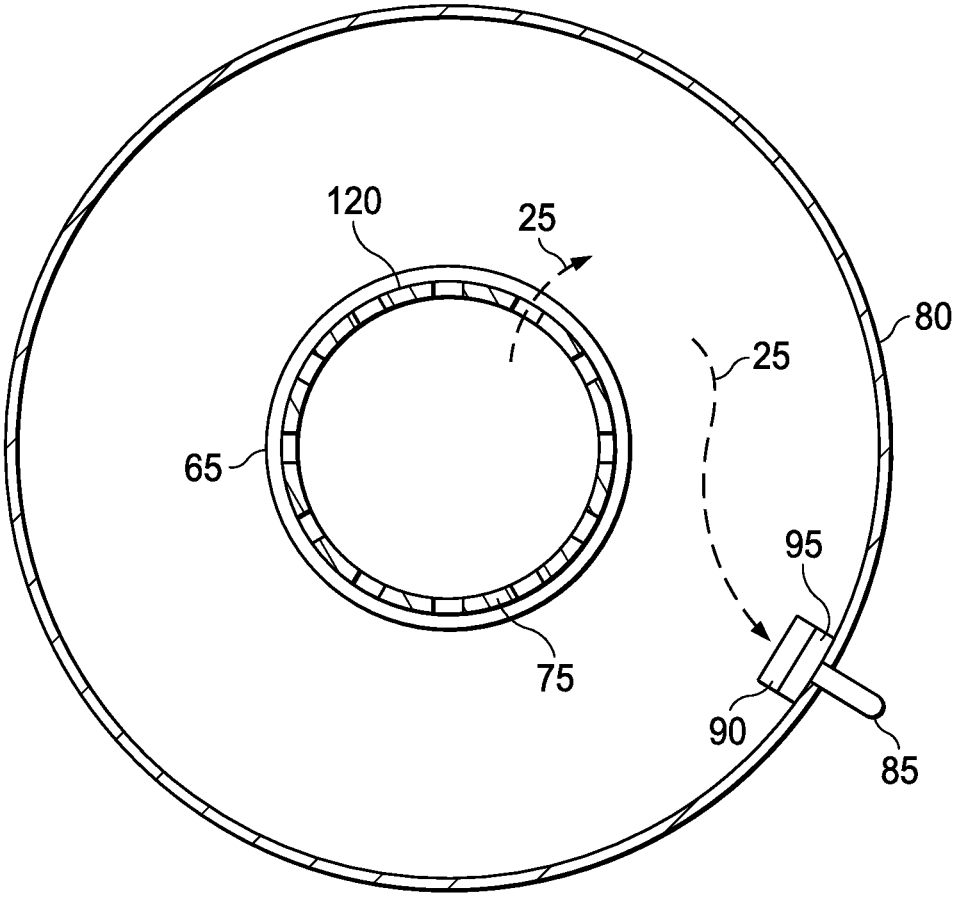
FIG. 4 is a schematic illustrating a top-down perspective of the reservoir fluid as it flows into a storage chamber in accordance with one or more examples described herein.

FIG. 4 is a schematic illustrating a top-down perspective of reservoir fluid 25 as it flows into storage chamber 80. As illustrated, the reservoir fluid 25 may flow uphole in the production tubing 65 after being discharged via the pump 55. The reservoir fluid may contact the filter 75 and enter the storage chamber 80 via filter openings 120 which generally align with openings made in production tubing 65. The storage chamber 80 may then be filled with the discharged reservoir fluid 25. The charged storage chamber 80 may remain at capacity until the discharge pressure drops to a point where it is reduced below the pressure threshold of sensor 90, which may then direct the opening of valve 95 as described above. The discharged reservoir fluid 25 may then enter tubing 85 where it may be recycled by being flowed to the pump intake 40 as illustrated in FIG. 1 to keep the pump intake filled with liquid and to increase the pump discharge pressure.

It should be clearly understood that the storage chamber 80 of FIG. 4 is merely one example of an application of the principles of this disclosure in practice, and a wide variety of other examples are possible. Therefore, the scope of this disclosure is not limited at all to the details of FIG. 4 described herein and/or depicted in any of the other FIGURES.

It is also to be recognized that the disclosed ESP assemblies may also directly or indirectly affect the various downhole equipment and tools that may contact the ESP assembly. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIGS. 1-4.

Provided are electric submersible pump assemblies in accordance with the disclosure and the illustrated FIGS. An example electric submersible pump assembly comprises an electric submersible pump comprising a pump intake, a storage chamber in fluid communication with the discharge side of the electric submersible pump, and a tubing configured to allow for fluid communication between the pump intake and the storage chamber such that fluid may flow from the storage chamber into the pump intake.

Additionally or alternatively, the electric submersible pump assemblies may include one or more of the following features individually or in combination. The storage chamber may comprise a sensor and a valve, wherein the sensor is configured to measure the discharge pressure of the pump, and wherein the valve is coupled to the tubing. The valve may open when the discharge pressure of the pump is reduced below a predetermined threshold. The valve may be a spring-loaded check valve. The electric submersible pump assembly may further comprise a filter, wherein the filter filters a portion of any solids dispersed within a fluid discharged from the pump from entering the storage chamber. The filter may be coupled to a production tubing, wherein the production tubing is disposed within an inner diameter of the storage chamber. The filter may be configured to allow fluid flow into the storage chamber but not out of the storage chamber. The electric submersible pump assembly may further comprise a motor and a seal assembly.

Provided are methods of operating an electric submersible pump in accordance with the disclosure and the illustrated FIGS. An example method comprises providing an electric submersible pump assembly comprising: an electric submersible pump comprising a pump intake, a storage chamber in fluid communication with the discharge side of the electric submersible pump, and a tubing configured to allow for fluid communication between the pump intake and the storage chamber such that fluid may flow from the storage chamber into the pump intake. The method further comprises flowing reservoir fluid into the pump intake; discharging reservoir fluid from the discharge side of the pump; storing the discharged reservoir fluid in the storage chamber; and flowing the discharged reservoir fluid into the tubing and into the pump intake.

Additionally or alternatively, the electric submersible pump assemblies may include one or more of the following features individually or in combination. The storage chamber may comprise a sensor and a valve, wherein the sensor is configured to measure the discharge pressure of the pump, and wherein the valve is coupled to the tubing. The valve may open when the discharge pressure of the pump is reduced below a predetermined threshold. The valve may be a spring-loaded check valve. The electric submersible pump assembly may further comprise a filter, wherein the filter filters a portion of any solids dispersed within a fluid discharged from the pump from entering the storage chamber. The filter may be coupled to a production tubing, wherein the production tubing is disposed within an inner diameter of the storage chamber. The filter may be configured to allow fluid flow into the storage chamber but not out of the storage chamber. The electric submersible pump assembly may further comprise a motor and a seal assembly. If the storage chamber comprises a valve, the method may further comprise sensing the discharge pressure of the pump, and opening the valve when the discharge pressure of the pump is reduced below a predetermined threshold. If the electric submersible pump assembly further comprises a filter, the method may further comprise filtering a portion of any solids dispersed within a fluid discharged from the pump from entering the storage chamber.

Provided are systems for operating an electric submersible pump in accordance with the disclosure and the illustrated FIGS. An example system comprises an electric submersible pump assembly comprising: an electric submersible pump comprising a pump intake, a storage chamber in fluid communication with the discharge side of the electric submersible pump, a tubing configured to allow for fluid communication between the pump intake and the storage chamber such that fluid may flow from the storage chamber into the pump intake, and a filter coupled to the storage chamber and a production tubing. The system further comprises the production tubing, wherein the production tubing is disposed within an inner diameter of the storage chamber.

Additionally or alternatively, the electric submersible pump assemblies may include one or more of the following features individually or in combination. The storage chamber may comprise a sensor and a valve, wherein the sensor is configured to measure the discharge pressure of the pump, and wherein the valve is coupled to the tubing. The valve may open when the discharge pressure of the pump is reduced below a predetermined threshold. The valve may be a spring-loaded check valve. The electric submersible pump assembly may further comprise a filter, wherein the filter filters a portion of any solids dispersed within a fluid discharged from the pump from entering the storage chamber. The filter may be coupled to a production tubing, wherein the production tubing is disposed within an inner diameter of the storage chamber. The filter may be configured to allow fluid flow into the storage chamber but not out of the storage chamber. The electric submersible pump assembly may further comprise a motor and a seal assembly.

The preceding description provides various embodiments of the apparatuses, systems, and methods disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

It should be understood that the compositions and methods are described in terms of "comprising," "containing," or "including" various components or steps. The compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned, as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified, and all such variations are considered within the scope and spirit of the present invention.

What is claimed is:

1. An electric submersible pump assembly comprising:

an electric submersible pump comprising a motor, a pump intake, and a discharge side, a storage chamber in fluid communication with the discharge side of the electric submersible pump, wherein the storage chamber comprises a sensor and a valve, wherein the sensor is configured to measure a discharge pressure of the discharge side of the pump, wherein the valve is coupled to a tubing, wherein the valve is a spring-loaded check valve, and the tubing configured to allow for fluid communication between the pump intake and the storage chamber such that fluid may flow from the storage chamber into the pump intake.

2. The electric submersible pump assembly of claim 1, wherein the valve opens when the discharge pressure of the pump is reduced below a predetermined threshold.

3. The electric submersible pump assembly of claim 1, further comprising a filter, wherein the filter filters a portion of any solids dispersed within a fluid discharged from the pump.

4. The electric submersible pump assembly of claim 3, wherein the filter is coupled to a production tubing, wherein the production tubing is disposed within an inner diameter of the storage chamber.

5. The electric submersible pump assembly of claim 3, wherein the filter is configured to allow fluid flow into the storage chamber but not out of the storage chamber.

6. The electric submersible pump assembly of claim 1, further comprising a seal assembly.

7. The electric submersible pump assembly of claim 1, wherein the electric submersible pump is a centrifugal pump.

8. A method of operating an electric submersible pump, the method comprising:

providing an electric submersible pump assembly comprising:

an electric submersible pump comprising a pump intake and a discharge side, a storage chamber in fluid communication with the discharge side of the electric submersible pump, wherein the storage chamber comprises a valve, wherein the valve is a spring-loaded check valve, and a tubing configured to allow for fluid communication between the pump intake and the storage chamber such that fluid may flow from the storage chamber into the pump intake;

flowing fluid into the pump intake;

discharging fluid from the discharge side of the pump;

sensing the discharge pressure of the pump;

opening the valve when a discharge pressure of the pump is reduced below a predetermined threshold;

storing the discharged fluid in the storage chamber; and then flowing the discharged fluid into the tubing and into the pump intake.

9. The method of claim 8, wherein the electric submersible pump assembly further comprises a filter; wherein the method further comprises filtering a portion of any solids dispersed within a fluid discharged from the pump.

10. The method of claim 9, wherein the filter is coupled to a production tubing, wherein the production tubing is disposed within an inner diameter of the storage chamber.

11. The method of claim 9, wherein the filter is configured to allow fluid flow into the storage chamber but not out of the storage chamber.

12. The method of claim 8, wherein the electric submersible pump assembly further comprises a motor and a seal assembly.

13. The method of claim 8, wherein the electric submersible pump is a centrifugal pump.

14. A system for operating an electric submersible pump, the system comprising:

an electric submersible pump assembly comprising:

an electric submersible pump comprising a pump intake and a discharge side, a storage chamber in fluid communication with the discharge side of the electric submersible pump, wherein the storage chamber comprises a sensor and a valve, wherein the sensor is configured to measure a discharge pressure of the pump, wherein the valve is coupled to a tubing, wherein the valve is a spring-loaded check valve, the tubing configured to allow for fluid communication between the pump intake and the storage chamber such that fluid may flow from the storage chamber into the pump intake, a filter coupled to the storage chamber and a production tubing; and the production tubing, wherein the production tubing is disposed within an inner diameter of the storage chamber.

15. The system of claim 14, wherein the valve opens when the discharge pressure of the pump is reduced below a predetermined threshold.

16. The system of claim 14, wherein the filter is configured to filter a portion of any solids dispersed within a fluid discharged from the pump.

17. The system of claim 14, wherein the filter is configured to allow fluid flow into the storage chamber but not out of the storage chamber.

18. The system of claim 14, wherein the electric submersible pump assembly further comprises a motor and a seal assembly.

19. The system of claim 14, wherein the electric submersible pump is a centrifugal pump.

20. The system of claim 14, wherein the electric submersible pump assembly is coupled to the production tubing with a threaded connection.

* * * * *